US008528764B2

(12) United States Patent
Chapple et al.

(10) Patent No.: US 8,528,764 B2
(45) Date of Patent: Sep. 10, 2013

(54) DRINK BOTTLE

(75) Inventors: Traci Chapple, Woodridge, IL (US); David Starr, Woodridge, IL (US); Jeffrey Chiu, Woodridge, IL (US); Mason Umholtz, Woodridge, IL (US); Stephanie Guttas, Woodridge, IL (US)

(73) Assignee: Wilton Industries, Inc., Woodridge, IL (US)

( * ) Notice: Subject to any disclaimer, the term of this patent is extended or adjusted under 35 U.S.C. 154(b) by 124 days.

(21) Appl. No.: 13/046,460

(22) Filed: Mar. 11, 2011

(65) Prior Publication Data

US 2011/0220605 A1 Sep. 15, 2011

Related U.S. Application Data

(60) Provisional application No. 61/313,416, filed on Mar. 12, 2010.

(51) Int. Cl.
*B65D 6/00* (2006.01)

(52) U.S. Cl.
USPC ..... 220/4.26; 220/4.21; 220/592.17; 220/737; 215/6; 215/388; 215/389

(58) Field of Classification Search
USPC ..... 220/4.21, 4.26, 592.17, 737; 215/6, 215/388, 389
See application file for complete search history.

(56) References Cited

U.S. PATENT DOCUMENTS

| | | | | | |
|---|---|---|---|---|---|
| 779,749 | A | * | 1/1905 | Tinling | 215/11.1 |
| 4,183,441 | A | * | 1/1980 | Erlandson | 215/12.2 |
| 4,478,346 | A | * | 10/1984 | Spong | 220/711 |
| 5,085,330 | A | * | 2/1992 | Paulin | 215/6 |
| D331,348 | S | * | 12/1992 | Park | D9/434 |
| D422,503 | S | * | 4/2000 | Lehn | D9/503 |
| 6,427,928 | B1 | * | 8/2002 | Hirota et al. | 239/33 |
| 2002/0130126 | A1 | * | 9/2002 | Rosenberg | 220/4.26 |
| 2009/0050595 | A1 | | 2/2009 | Lackey | |
| 2009/0107582 | A1 | | 4/2009 | Sayage | |
| 2010/0072159 | A1 | | 3/2010 | Yang | |

OTHER PUBLICATIONS

H2-0872310 Hydration Bottle, H@—Trudeau Corporation, new products, 1 page, Feb. 17, 2012, http://www.trudeaucorp.com/us2/products/new/p--0872310.html.

* cited by examiner

*Primary Examiner* — Anthony Stashick
*Assistant Examiner* — Elizabeth Volz
(74) *Attorney, Agent, or Firm* — Foley & Lardner LLP

(57) ABSTRACT

A drink bottle comprising a lower bottle portion and an upper bottle portion configured to removably connect to form a liquid-tight seal. The upper bottle portion includes a connection portion engageable with a connection portion of the lower bottle portion. The drink bottle further includes a sleeve configured to be arranged about one of the upper bottle portion and the lower bottle portion.

5 Claims, 7 Drawing Sheets

DRINK BOTTLE

CROSS-REFERENCE TO RELATED APPLICATIONS

This application claims priority under 35 U.S.C. §119(e) to provisional U.S. Patent Application No. 61/313,416, filed on Mar. 12, 2010, the disclosure of which is expressly incorporated by reference herein in its entirety.

BACKGROUND OF THE INVENTION

1. Field of the Invention

The invention is directed generally to a drink bottle and, more particularly, to a reusable drink bottle that includes a number of user-friendly features, 2. Related Art Typical disposable drink bottles are formed of a clear material, have a typically taller construction with a narrow spout that is closable. Users find this arrangement to be very desirable in that such a shape is usually easily carried and the drink that is contained in the drink bottle can be easily dispensed through the smaller spout and closed for later use. However, typical disposable water bottles cannot be readily reused in that they are not easily cleaned. For example, the smaller spout of such bottles does not allow one to easily and fully clean the inside of the bottle. Additionally, the light weight construction of such disposable bottles does not allow them to be dishwasher safe. In that regard, if disposable bottles are cleaned multiple times, the water bottle material deteriorates to some degree. Finally, such disposal water bottles do not lend themselves to being used in conjunction with a drink that has additional ingredients such as ice. In that regard, the small drink spouts of a typical disposable drink bottle do not allow large pieces of ice or drink powders to be easily put into the water bottle and accordingly users will typically not use such disposable water bottles in that way. In this regard, users of disposable water bottles will use the bottle once and then dispose of it. This causes a great deal of waste in that water bottles will be sent to a landfill or the like. Even, if the user recycles the water bottle there is a certain level of waste and energy needed to turn that water bottle into some sort of recycled product.

SUMMARY OF THE INVENTION

The invention meets the foregoing needs and provides a drink bottle that includes a tall shape and clear construction, together with the ability to be easily cleaned, and/or used with ingredients and that furthermore includes other advantages apparent from the discussion herein.

The invention may be implemented in a number of ways. According to one aspect of the invention a drink bottle comprises a lower bottle portion configured to hold a liquid and having a connection portion along an upper part thereof. The drink bottle further comprises an upper bottle portion configured to removably connect with the lower bottle portion and further configured to form a liquid-tight seal therebetween. A sleeve is configured to be arranged about one of the upper bottle portion and the lower bottle portion. The upper bottle portion includes a drink spout at the upper end thereof.

Accordingly, in one aspect of the invention a drink bottle comprising a lower bottle portion having a sidewall and a bottom. The sidewall has a lower bottle engagement portion. The drink bottle further comprises an upper bottle portion having a sidewall and a spout. The sidewall has an upper bottle engagement portion, a middle bottle portion having a sidewall with a first sidewall engagement portion adjacent a first edge of the sidewall and a second sidewall engagement portion adjacent a second edge of the sidewall. The lower bottle engagement portion is removably securable to the second sidewall engagement portion and the upper bottle engagement portion and the upper bottle engagement portion is removably securable to the first sidewall engagement portion and the lower bottle engagement portion.

According to another aspect of the invention a drink bottle comprises a lower bottle portion configured to hold a liquid and having a connection portion along an upper part thereof. The drink bottle further comprises an upper bottle portion configured to removably connect with the lower bottle portion and further configured to form a liquid-tight seal therebetween. The drink bottle has a sleeve configured to be removably affixed about one of the upper bottle portion and the lower bottle portion. The upper bottle portion includes a drink spout at the upper end thereof.

Additional features, advantages, and embodiments of the invention may be set forth or apparent from consideration of the following detailed description, drawings, and claims. Moreover, it is to be understood that both the foregoing summary of the invention and the following detailed description are exemplary and intended to provide further explanation without limiting the scope of the invention as claimed.

BRIEF DESCRIPTION OF THE DRAWINGS

The accompanying drawings, which are included to provide a further understanding of the invention, are incorporated in and constitute a part of this specification, illustrate embodiments of the invention and together with the detailed description serve to explain the principles of the invention. No attempt is made to show structural details of the invention in more detail than may be necessary for a fundamental understanding of the invention and the various ways in which it may be practiced. In the drawings.

DETAILED DESCRIPTION OF THE INVENTION

Figure 1:
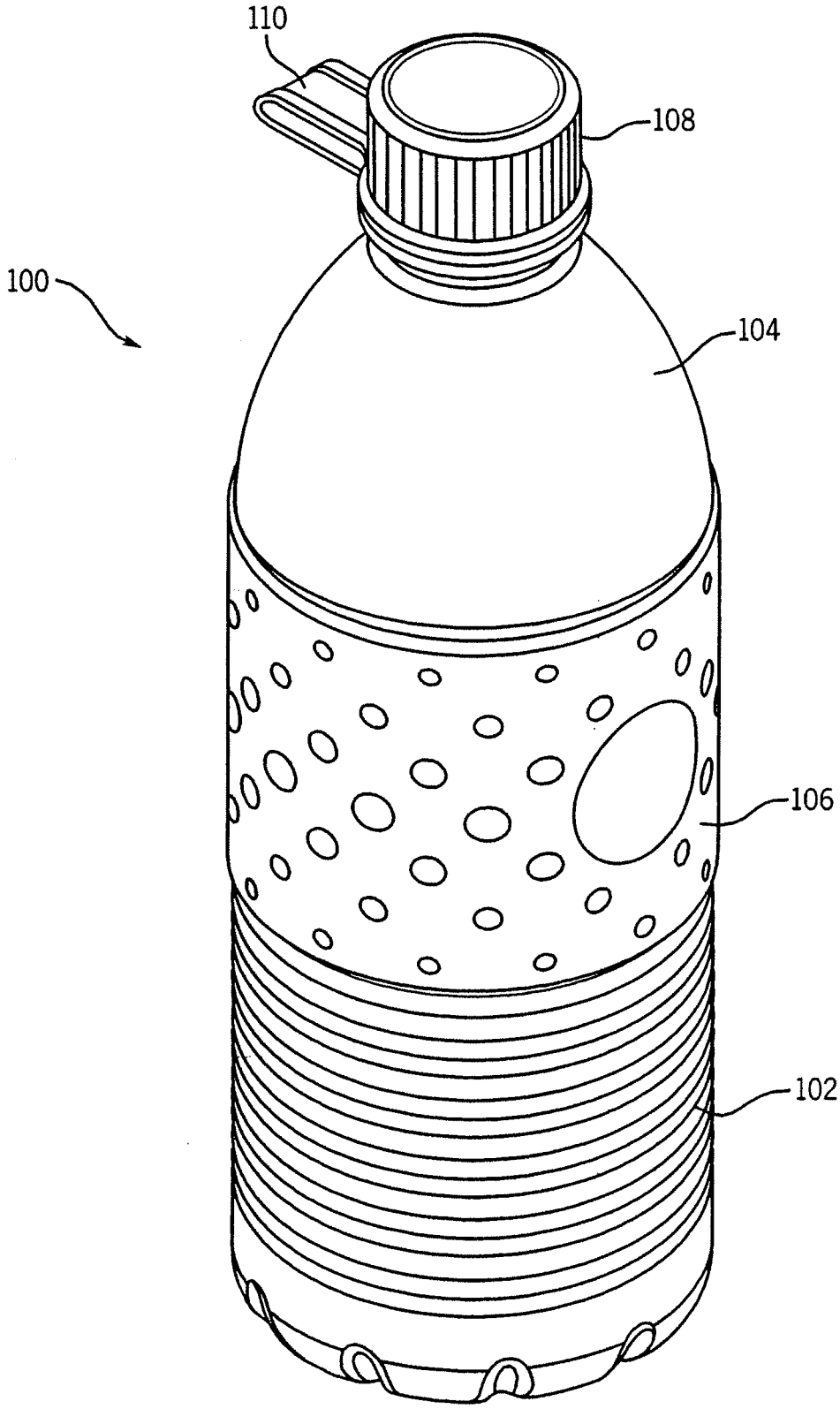
FIG. 1 shows a drink bottle constructed according to the principles of the invention.

The embodiments of the invention and the various features and advantageous details thereof are explained more fully with reference to the non-limiting embodiments and examples that are described and/or illustrated in the accompanying drawings and detailed in the following description. It should be noted that the features illustrated in the drawings are not necessarily drawn to scale, and features of one embodiment may be employed with other embodiments as the skilled artisan would recognize, even if not explicitly stated herein. Descriptions of well-known components and processing techniques may be omitted so as to not unnecessarily obscure the embodiments of the invention. The examples used herein are intended merely to facilitate an understanding of ways in which the invention may be practiced and to further enable those of skill in the art to practice the embodiments of the invention. Accordingly, the examples and embodiments herein should not be construed as limiting the scope of the invention, which is defined solely by the appended claims and applicable law. Moreover, it is noted that like reference numerals represent similar parts throughout the several views of the drawings.

Figure 2:
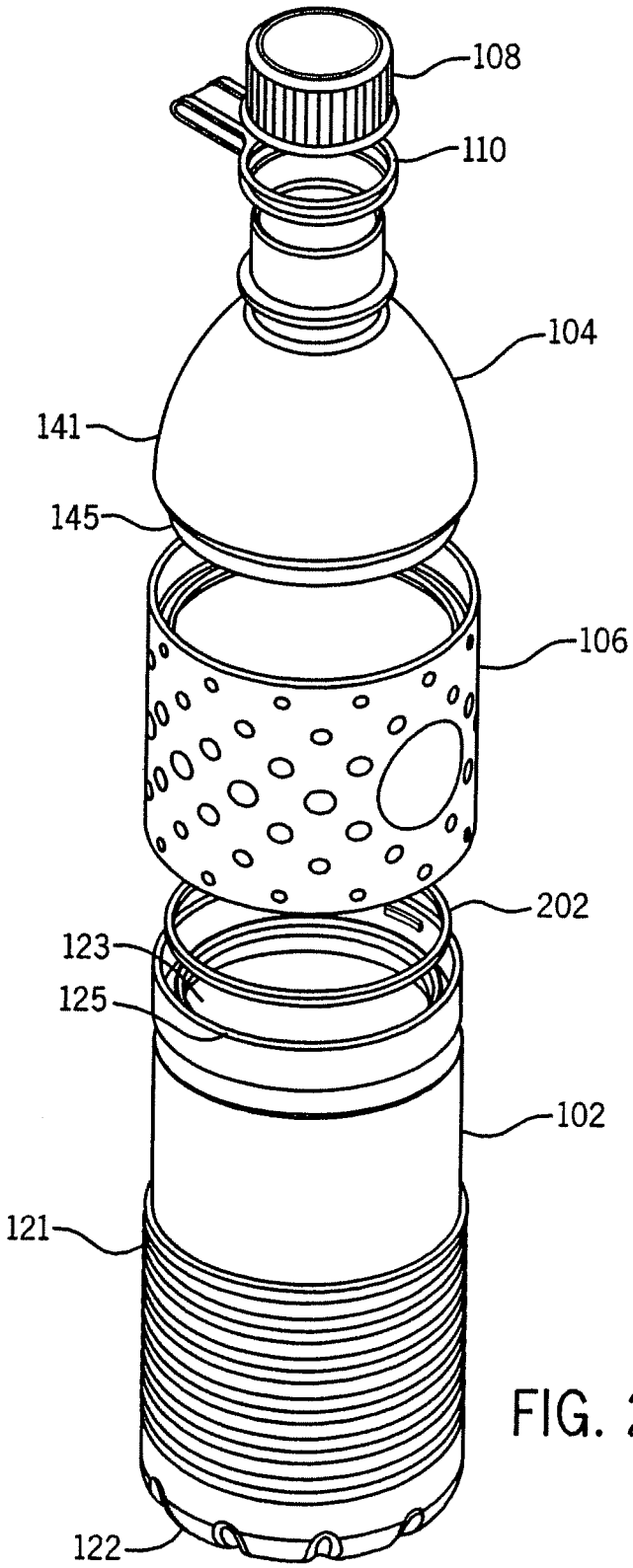
FIG. 2 shows an exploded view of the drink bottle constructed according to the principles of the invention.

FIG. 1 shows a drink bottle constructed according to the principles of the invention; and FIG. 2 shows an exploded view of the drink bottle constructed according to the principles of the invention. In particular, FIG. 1 shows a drink bottle 100 having an upper bottle portion 104 connected to a lower bottle portion 102. More specifically, the upper bottle portion 104 and the lower bottle portion 102 have a construction such that the two may be connected together in order to have a liquid tight seal between the two and may be separated from one another to form a large opening in order to be cleaned and/or so that a user may add ingredients such as ice or the like to the drink bottle easily.

The drink bottle 100 may also include a sleeve 106. The sleeve 106 may provide a surface for a user to easily grip and may also have insulating properties as well. The sleeve 106 is shown in FIG. 1 as being arranged on the lower bottle portion 102. However, sleeve 106 may be just as easily be arranged on the upper bottle portion 104, and in particular if upper bottle portion 104 extended further down vertically. The sleeve 106 may be primarily disposed about one of the lower bottle portion 102 or the upper bottle portion 104 with a smaller portion of the sleeve 106 disposed about the other of the lower bottle portion 102 or the upper bottle portion 104.

The drink bottle 100 may also include a narrow spout (404 shown in FIG. 4) which a user can drink from. The spout may have a closure. The closure may be a bottle cap, twist open cap, pop-up opening, or the like and generically referred to herein as a bottle cap 108. In one embodiment, a straw is provided, for example, but not limited to, as an integral part of the cap or as a separate stand-alone structure.

Accordingly, in one embodiment, the drink bottle 100 of the invention includes two sections that may be separated, such as by manual action, as shown in FIG. 2 between the lower bottle portion 102 and upper bottle portion 104 and may also have a narrow drink spout. The spout 404 may be closed with a bottle cap 108, and may include the sleeve 106 that provides an attractive and insulating gripping surface for the drink bottle 100. Accordingly, the drink bottle 100 allows for the drink bottle 100 to be easily cleaned, be dishwasher friendly, and include materials that are FDA food approved and that meet California Proposition 65 standards. Finally the drink bottle 100 may include a construction that does not easily trap food.

The drink bottle 100 may also further include a tether 110 to connect the bottle cap 108 in a tethered fashion to the drink bottle 100. In that regard, the tether 110 may be constructed such that it allows the bottle cap 108 to freely spin so that it may be unthreaded or disconnected from the bottle 100 and then can freely hang from the tether along the side of the bottle 100 and not be lost or misplaced. As shown in FIG. 2, the drink bottle 100 may also include a gasket 202 arranged between the upper bottle portion 104 and the lower bottle portion 102. The gasket 202 may be formed of silicone or other similar material that forms a liquid tight seal when the upper bottle portion 104 is arranged and attached to a lower bottle portion 102.

The lower bottle portion 102 includes a sidewall 121, a bottom portion 122, and an upper opening 123. In one embodiment, the lower bottle portion is substantially cylindrical, with the sidewall 121 corresponding to the curved surface of a cylinder and the bottom portion 122 corresponding to a bottom face of a cylinder and the upper opening 123 corresponding to the top face of a cylinder. The sleeve 106, in embodiments where the sleeve is disposed about the lower bottle portion 102, is disposed about the lower bottle portion sidewall 121. In embodiments of the lower bottle portion having threading, the threading may be on an exterior face of the sidewall 121, on an interior face, or both. In one embodiment, the lower bottle portion 102 includes a lower bottle engagement portion 125 adjacent the upper opening 123.

Lower bottle portion 102 may be manufactured using a blow molding process. However, it is contemplated that other types of manufacturing processes may be used. The material of lower bottle portion 102 may be, in one embodiment, an appropriate polymer, such as Tritan™. However, other materials with similar qualities may also be used. Finally, the lower bottle portion 102 may be formed of a transparent, translucent, or opaque material in order to emulate the common disposable water bottle.

The upper bottle portion 104 includes a sidewall 141, a lower opening 143, and the spout 404. The sidewall 141 defines the lower opening 143 and extends therefrom to the spout 404. The sleeve 106, in embodiments where the sleeve is disposed about the upper bottle portion 104, is disposed about the upper bottle portion sidewall 141. In embodiments of the upper bottle portion 104 having threading, the threading may be on an exterior face of the sidewall 141, on an interior face, or both. In one embodiment, the upper bottle portion 104 includes an upper bottle engagement portion 145 adjacent the lower opening 143. The lower bottle engagement portion 125 is removably securable to the upper bottle engagement portion 145.

The upper bottle portion 104 may also be formed of blow molding. However, other types of manufacturing processes are also contemplated. Upper bottle portion 104 may be, in one embodiment, an appropriate polymer, such as Tritan™. However, other materials with similar qualities may also be used. Finally, the upper bottle portion 104 may be formed of a transparent, translucent, or opaque material in order to emulate the common disposable water bottle. However, other materials and/or constructions are also contemplated. Additionally, in one embodiment, the upper bottle portion 104 is formed of generally thicker material than the typical disposable type water bottle.

Figure 3:
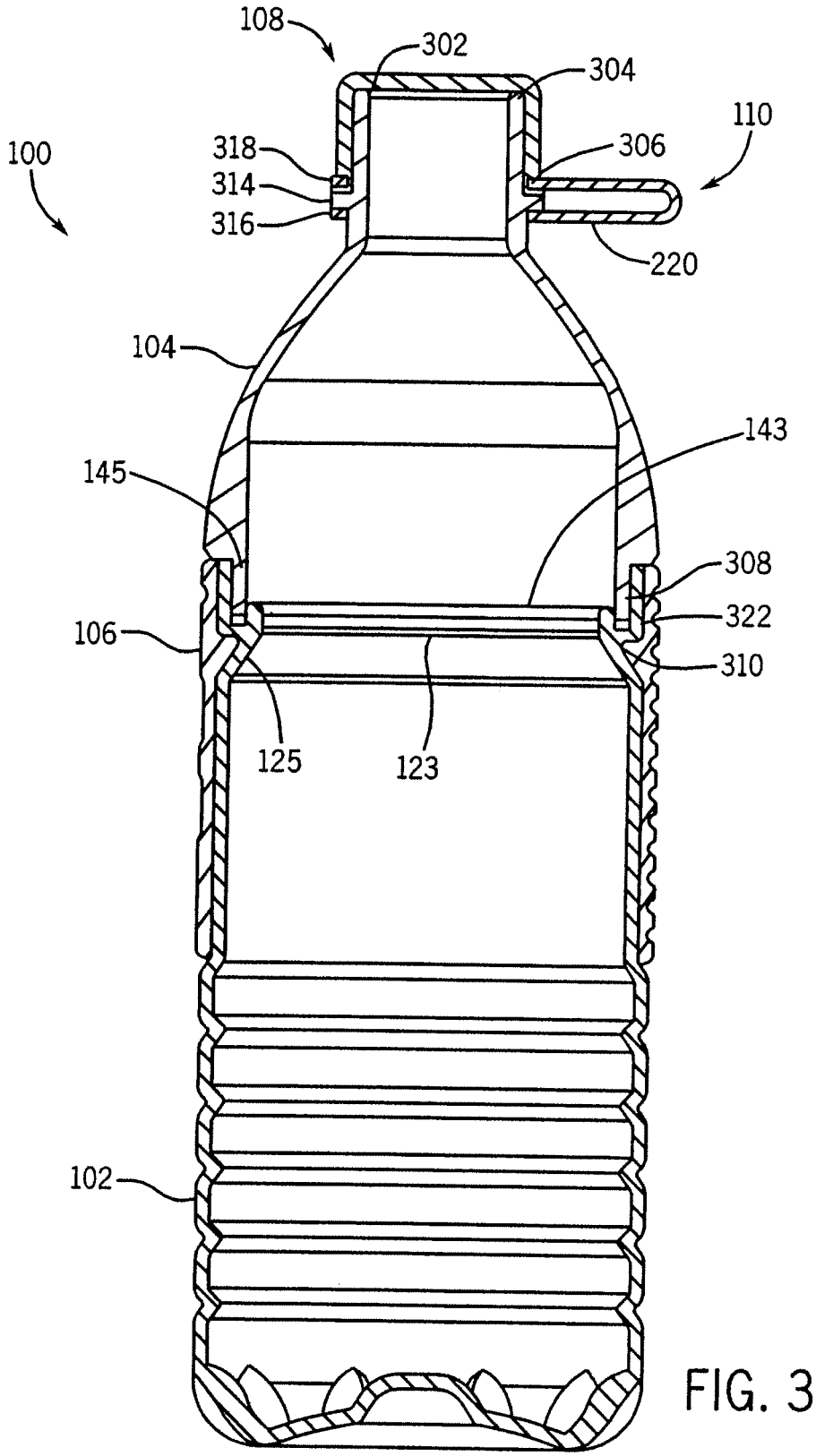
FIG. 3 shows a cross-section of the drink bottle constructed according to the principles of the invention.

FIG. 3 shows a cross-section of the drink bottle constructed according to the principles of the invention. In particular, FIG. 3 shows the details of the bottle cap 108 in an aspect when implemented as a twist on cap. In particular, the bottle cap 108 and the spout portion of the drink bottle 100 may include threading 304 on one or both surfaces thereof. In a particular aspect, the threading will be such that a quarter turn will release the bottle cap from the spout. However other threading or attachment arrangements are contemplated, such as friction fit. The bottle cap 108 may also include an interference gasket 302 arranged in the bottle cap 108. Accordingly, when the bottle cap 108 is arranged on the spout of the drink bottle 100, the interference gasket 302 will form a liquid tight seal therebetween. Additionally, the bottle cap 108 may include a connection to the tether 110. The bottle cap—tether connection 306 may be configured so that the bottle cap 108 may be able to rotate with respect to the tether 110. In that regard, the bottle cap 108 may include a slot therearound in which the tether 110 can rotate with respect to the bottle cap 108.

In a particular aspect, the tether 110 may include an upper tether ring 318. It is this upper tether ring 318 that may be arranged in the slot of the bottle cap 108 to form a connection with the same. This upper tether ring 318 may be sized such that it will allow the bottle cap 108 to rotate freely about the upper tether ring 318. The tether 110 may also include a lower tether ring 316. The lower tether ring 316 may be arranged about the spout of the drink bottle 100. The drink bottle 100 may further include a retaining ring 314 that will limit the ability of the tether 110 and, in particular, the retaining ring 314 to not be disconnected easily from the drink bottle 100. The connection between the retaining ring 314 and the lower tether ring 316 may also be such that it rotates freely with respect to one another. Finally, the tether 110 may include a tether connection 320, connecting the upper tether ring 318 to the lower tether ring 316.

Figure 6:
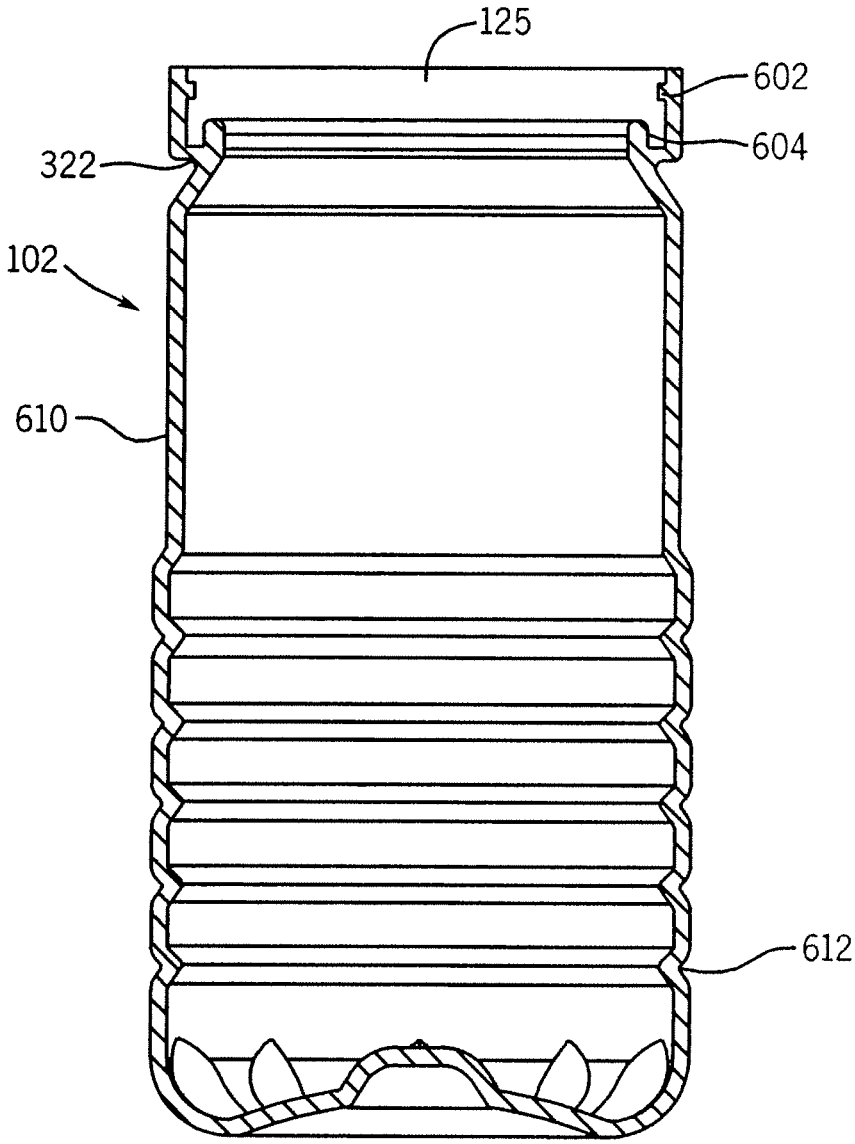
FIG. 6 shows a cross-section of the lower bottle portion of the drink bottle constructed according to the principles of the invention.

As further shown in FIG. 3, the upper bottle portion 104 may include threads 308. The threads 308 may interact with corresponding threads in the lower bottle portion 102 as shown in FIG. 6. More specifically as shown in FIG. 6, threads 602 mesh with the threads 308 shown in FIG. 3.

As further shown in FIG. 3, the sleeve 106 is shown as arranged on the lower bottle portion 102. The sleeve 106 may be formed from injection molding. However, other types of manufacturing processes are also contemplated. Additionally, the sleeve 106 may be formed of TPE. The sleeve 106 may be any sort of fanciful colors, textures, patterns or the like. The sleeve 106 is engagable with the lower bottle portion 102, the upper bottle portion 104 or both. In one embodiment, the sleeve 106 is affixed to the lower bottle portion 102 and arranged about a portion of the lower bottle portion 102 and the upper bottle portion 104. In an alternative embodiment, the sleeve 106 is affixed to the upper bottle portion 104 and arranged about a portion of the lower bottle portion 102 and the upper bottle portion 104. The sleeve may be affixed via friction fit. The sleeve 106 may comprise a protrusion 309 that is engageable with a recess 321 of the respective upper bottle portion 104 or lower bottle portion 102 with which the sleeve 106 is engagable. In one embodiment, the protrusion 309 is an annular ridge 310 engageable with an annular groove 322. It should be appreciated that the respective positions of the protrusion 309 and the recess 321 may be switched such that the lower bottle portion 102 or upper bottle portion 104 contains the protrusion 309 and the sleeve 106 includes the recess 321, the protrusion 309 being arranged in the recess 322 to help reduce the possibility that the sleeve 106 may slide off the drink bottle 100.

Figure 4:
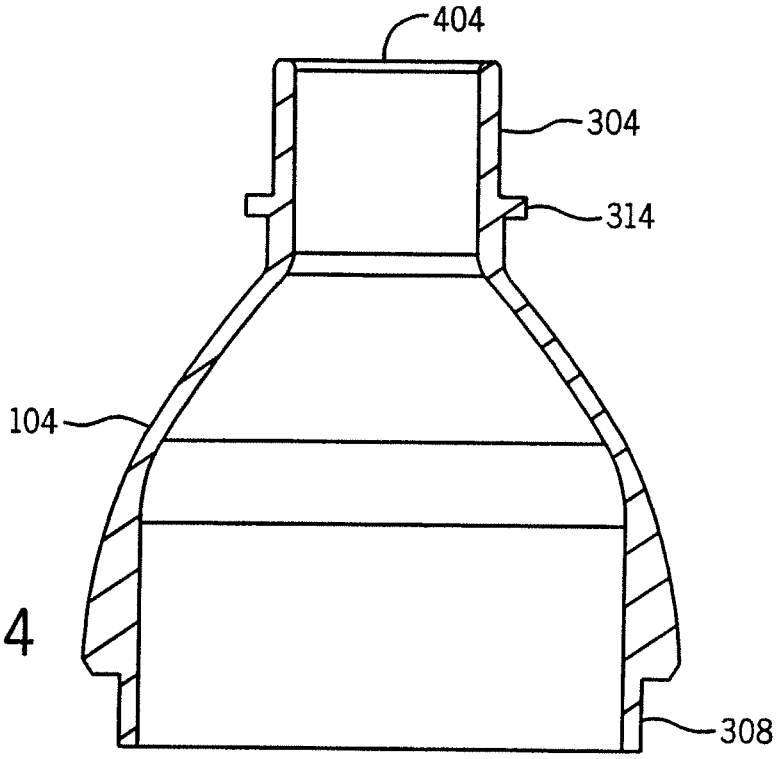
FIG. 4 shows a cross-section of the top of the drink bottle constructed according to the principles of the invention.
Figure 5:
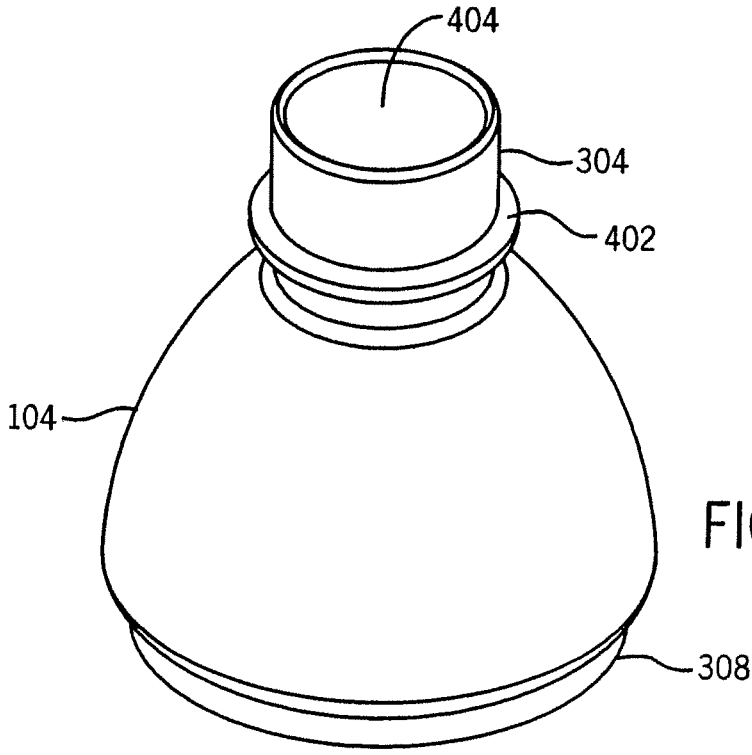
FIG. 5 shows a perspective view of the top of the drink bottle constructed according to the principles of the invention.

FIG. 4 shows a cross-section of the top of the drink bottle constructed according to the principles of the invention; and FIG. 5 shows a perspective view of the top of the drink bottle constructed according to the principles of the invention. In particular, FIG. 4 shows the upper bottle portion 104, the drink spout 404, and the retaining ring 314.

Figure 7:
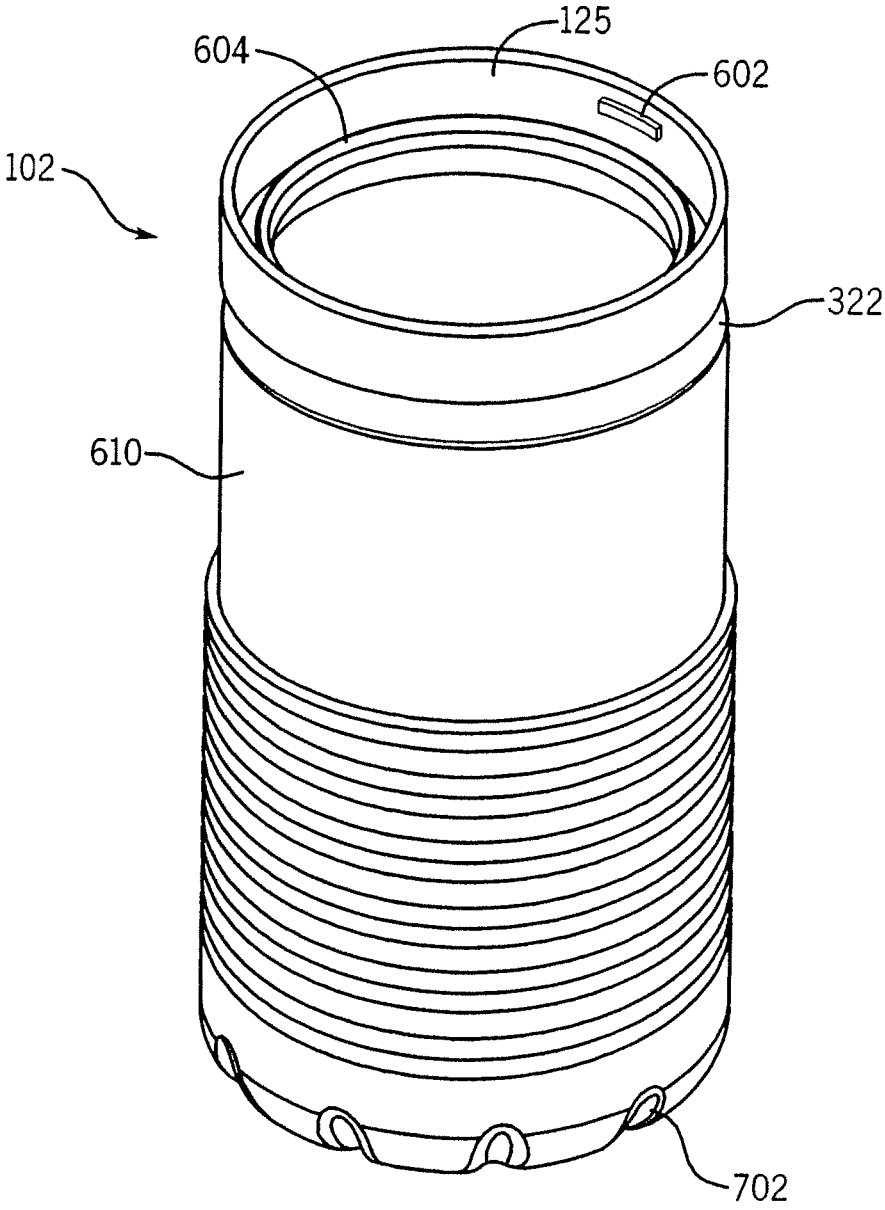
FIG. 7 shows a perspective view of the lower bottle portion of the drink bottle constructed according to the principles of the invention.

FIG. 6 shows a cross-section of the lower bottle portion of the drink bottle constructed according to the principles of the invention; and FIG. 7 shows a perspective view of the lower bottle portion of the drink bottle constructed according to the principles of the invention. In particular FIG. 6 shows the details of one embodiment of the lower bottle portion 102. More specifically, FIG. 6 shows the details of the annular recess 322 and how the sleeve 106 and annular protrusion 310 may interact therewith.

FIG. 6 further shows the lower bottle engagement portion 125. The lower bottle engagement portion 125 is constructed to receive the upper bottle engagement portion 145. In this regard, the lower bottle engagement portion 125 may include threads 602 as shown in FIG. 6. The lower bottle engagement portion 125 further may include a ring 604 for holding the gasket 202 shown in FIG. 2. Although FIG. 6 illustrates the upper bottle portion 104 as fitting within the lower bottle portion 102 with interaction of threads 308 between the upper bottle portion and lower bottle portion, it should be appreciated that the arrangement may be reversed, with the upper bottle portion 104 exterior to the lower bottle portion 102, and the upper bottle portion 104 having the ring 604 for retaining the gasket 202, without departing from the scope of the invention.

Additionally, the lower bottle portion 102 may include a plurality of horizontal ribs 612. The plurality of horizontal ribs 612 may create a stronger construction and increase the strength of the lower bottle portion 102 and also mimics similarities to the typical disposable water bottles. A smooth portion 610 may be provided, such as for interacting with the sleeve 106. The lower bottle portion 102 may also include a plurality of lower groove portions 702 as shown in FIG. 7. In one embodiment, the plurality of lower groove portions 702 extend from the side of the lower bottle portion 102 to the bottom of the lower bottle portion 102. These increase the strength of the lower bottle portion 102 and also give the drink bottle 100 the appearance of an iconic disposable water bottle.

In one embodiment, a middle bottle portion 103 is provided. The middle bottle portion 103 has a sidewall 131, an upper middle bottle portion opening 133 and a lower middle bottle portion opening 134. In one embodiment, the middle bottle portion 103 has a substantially cylindrical shape wherein the sidewall 131 corresponds to the curved face of a cylinder, the upper middle bottle portion opening 133 corresponds to the upper face of a cylinder and the lower middle bottle portion opening 134 corresponds to the lower face of a cylinder. In one embodiment, the middle bottle portion 103 includes a first sidewall engagement portion 135 adjacent the upper middle bottle portion opening 133 and a second sidewall engagement portion 136 adjacent the lower middle bottle portion opening 134. The lower bottle engagement portion 125 is removably securable to the second sidewall engagement portion 136 and the upper bottle engagement portion 145 is removably securable to the first sidewall engagement portion 135 and the lower bottle engagement portion 125.

Figure 8:
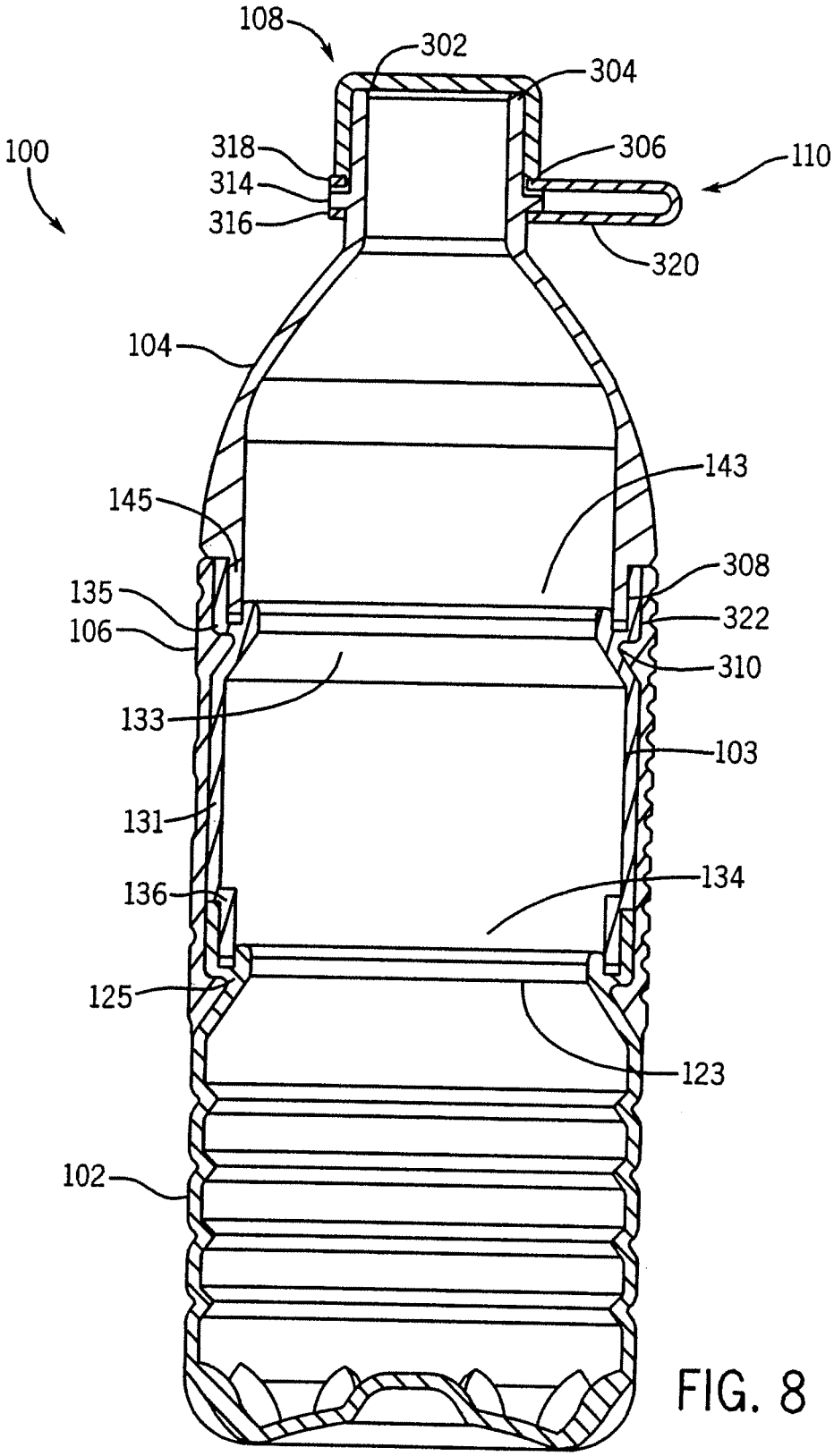
FIG. 8 shows a cross-section of one embodiment of a drink bottle having a lower bottle portion, a middle bottle portion, and an upper bottle portion.

Thus, FIG. 8 shows the upper bottle portion 104 connected to the middle bottle portion 103 connected to the lower bottle portion 102, thus defining the drink bottle 100. The middle bottle portion 103 may be removed and the upper bottle portion 104 connected directly to the lower bottle portion 102, allow a user to alter the volume of the drink bottle 100.

While the invention has been described in terms of exemplary embodiments, those skilled in the art will recognize that the invention can be practiced with modifications in the spirit and scope of the appended claims. These examples given above are merely illustrative and are not meant to be an exhaustive list of all possible designs, embodiments, applications, or modifications of the invention.

What is claimed is:

1. A drink bottle comprising:

a lower bottle portion configured to hold a liquid and having a connection portion along an upper part thereof, the lower bottle portion including a plurality of a ribs;

an upper bottle portion having an upper bottle connection portion along a lower part thereof configured to removably directly connect with the lower bottle portion connection portion and further configured to form a liquid-tight seal therebetween;

a ring for holding a gasket, the ring positioned in one of the upper bottle portion or lower bottle portion and configured to engage the other of the upper bottle portion or lower bottle portion to form the liquid-tight seal; and a sleeve configured to be removably affixed to the lower bottle portion below the lower bottle portion connection portion and above the plurality of ribs, wherein the upper bottle portion includes a drink spout at the upper end thereof.

2. The drink bottle according to claim 1 where the sleeve is affixed to the lower bottle portion and arranged about a portion of the lower bottle portion and the upper bottle portion.

3. The drink bottle of claim 2, wherein the sleeve comprises an annular ridge engageable with a corresponding annular groove on the lower bottle portion.

4. The drink bottle of claim 1, wherein the sleeve comprises an annular ridge engageable with a corresponding annular groove on the lower bottle portion.

5. The drink bottle according to claim 1, wherein the spout includes an integral straw.

* * * * *